US006502326B1

(12) United States Patent
Bielfeldt

(10) Patent No.: US 6,502,326 B1
(45) Date of Patent: Jan. 7, 2003

(54) METHOD AND APPARATUS FOR DEWATERING FIBER CELLS

(75) Inventor: Friedrich B. Bielfeldt, Pahl a.A (DE)

(73) Assignee: Maschinenfabrik J. Dieffenbacher GmbH & Co., Eppingen (DE)

( * ) Notice: Subject to any disclaimer, the term of this patent is extended or adjusted under 35 U.S.C. 154(b) by 0 days.

(21) Appl. No.: 09/645,575

(22) Filed: Aug. 25, 2000

(30) Foreign Application Priority Data

Aug. 25, 1999 (DE) ..... 199 40 392

(51) Int. Cl.[7] ..... F26B 7/00

(52) U.S. Cl. ..... 34/384; 34/381; 34/386; 34/388; 34/398; 210/771

(58) Field of Search ..... 34/380, 397, 476, 34/481, 482, 493, 507, 510, 398, 400, 386, 381, 384, 388; 210/770, 771, 772

(56) References Cited

U.S. PATENT DOCUMENTS

| | | | | |
|---|---|---|---|---|
| 2,578,357 A | * | 12/1951 | Hyslop | 34/502 |
| 3,623,234 A | * | 11/1971 | Knauf | 34/393 |
| 5,862,612 A | * | 1/1999 | Bielfeldt | 34/398 |
| 5,862,746 A | * | 1/1999 | Bielfeldt | 100/73 |
| 5,887,514 A | * | 3/1999 | Bielfeldt | 100/37 |
| 5,900,139 A | | 5/1999 | Bielfeldt | |
| 6,224,698 B1 | * | 5/2001 | Endo | 156/60 |

FOREIGN PATENT DOCUMENTS

| | | |
|---|---|---|
| DE | 195 35 315 | 3/1997 |
| DE | 195 37 286 | 6/1997 |
| DE | 197 10 708 | 9/1998 |
| DE | 197 10 711 | 9/1998 |

* cited by examiner

*Primary Examiner*—Ira S. Lazarus
*Assistant Examiner*—Kathryn S. O'Malley
(74) *Attorney, Agent, or Firm*—Foley & Lardner

(57) ABSTRACT

A method and apparatus for reducing the moisture content bound by capillarity in fiber cells of solid materials containing carbon. The material is ground and screened to form a loose sheet of the solid materials and/or sludges. The material is processed by screening and grinding methods for a plurality of hoppers for different grain sizes and grain size distributions. A thin layer of fines is spread as a first layer onto the spreading, feeding and filter belt, and a substantially thicker coarse material layer is formed as a second layer to form a sandwich of the material. The fines layer depth $H_F$ and coarse material depth $H_G$ of the sandwich correspond to the consistency and the proportion of the fines of the material. The sandwich formed is then carried by a belt into the pressure chamber of the filter press according to the dewatering cycle, while simultaneously the squeezed-out dry material is carried away.

21 Claims, 5 Drawing Sheets

METHOD AND APPARATUS FOR DEWATERING FIBER CELLS

BACKGROUND OF THE INVENTION

The invention relates to a method and apparatus for reducing the moisture content bound by capillarity in fiber cells.

According to DE 195 35 315 A1, from which the invention sets out, a good, uniform permeability of the outspread bulk material in the process for the mechanical/thermal dewatering (MTE) of biological (fossil) and/or mineral bulk materials is the necessary requirement for a uniform thermal processing of the granulated bulk material spread out in the pressure chamber. For this purpose the coarsely granular raw material to be dewatered, with grain sizes of, for example, >0 to 50 mm, preferably >0 to 30 mm, is put through a process of comminution. Grain size is an optimal process parameter in regard to the ratio of grain surface to the grain volume in the transfer of the sensible heat of the hot process water from the previous press batch as well as the vapor condensation that follows in the course of the process. Depending on consistency, that is screen grain size distribution of the raw material to be ground with respect to the percentage of the fine grain to the coarse grain as well as the way in which the coarse lumps fracture, more or less fine material is produced with a grain size of less than one millimeter. A greater fine material content of >0 to 1 mm in the range of more than 6 to a maximum of 10% of the entire raw material as the bulk material, leads to uncontrollable unequal distribution of the fine material content in the poured bulk material. This unequal sifted grain size distribution leads to unequal resistance to the washing and therefore leads to pathways uncontrollably occurring in the bulk material within the pressure chamber. This unequal permeability interferes with the uniform transfer of heat to the granular material. This irregular thermal processing of the bulk material causes very irregular and unacceptable degrees of moisture reduction, so that the process as such and the economy of the process are cast into doubt.

Thus it has been found in the practice of such processes and the use of apparatus for raw brown coal with a capillarity-bound moisture content of about 55 to 65 weight-percent, that

- with grain sizes <1 mm and a percentage in the bulk of more than 6 to 10% of the bulk, due to uneven permeability, pockets of moisture are still present after the dewatering process,
- with grain sizes <1 mm and a content in the bulk of less than 10%, even with an irregular sifted grain distribution or separation effects in the bulk, uniform permeability and thus a uniform and good dewatering is achieved, and
- with a reduction of the content of the grain sizes under 1 mm to ≦6%, the degree of dewatering is markedly improved, up to ≦20%.

In the screening of the material to be dewatered by the former methods it was a disadvantage that the fine materials above the critical content or critical permeability limit (i.e. 10% of the bulk content having grain sizes of less than 1 mm) with up to 35% residual fines content of the entire material could not be fed back to the MTE process.

SUMMARY OF THE INVENTION

For the solution of the problem described, the purpose of the invention is to create an optimum screened grain size distribution for the bulk material and establish it so that a heretofore unacceptable high fines content can be fed to the MTE material without interfering with a good, uniform dewatering process.

The solution of this problem consists in that the input material is processed by screening and comminution and fed separately to several spreader hoppers, wherein, in a first part, the coarse material is separately fed to a first spreader hopper such that the coarse material contains only a measured residual amount of fine material below the critical permeability limit, while at the same time the fines thus separated with a grain size of <3 to >0 mm are fed to a second spreader hopper, while the second spreader hopper which is ahead of the first coarse material spreader hopper spreads a first thin layer of fines on the spreading, feeding and filter belt and then a substantially thicker coarse material layer from the first spreader hopper is laid on as the second layer to form a sandwich of spread material, while the application of the fines depth $H_F$ and coarse material depth $H_G$ of the sandwich is performed corresponding to the consistency and the percentage content of the fines of the input material used, and the sandwiched layer formed in the two preceding steps is delivered by the spreading, feeding and filter belt into the MTE pressure chamber of the filter press according to the dewatering cycle, while at the same time the squeezed-out dry material is discharged.

In a first embodiment of an apparatus for the practice of the method, the problem is solved in that the arrangement of several hoppers in tandem, wherein the bulk material is treated by comminution and screening, the coarse material is transferred into a first spreading hopper, and the screened-out fines are carried over a chute and conveyor belt into a second spreading hopper. The material is then passed through a system in which the fines can be deposited first in a thin layer and the coarse material is deposited from the spreading hoppers in a thick layer thereon through sliding gates controlling the depth of the layer. The deposited material is then passed onto the spreading, feeding and filter belt so as to form a sandwich.

A second embodiment of an apparatus according to claim 8 divides the material by arranging a plurality of screening devices connected in tandem into ever decreasing grain sizes and it feeds the material on conveyor belts into spreading hoppers arranged separately in tandem, so that the fines and the superfines can be applied to the spreading, feeding and filter belt with the smallest grain size first in two thin layers, and thereafter the coarse material can be applied thereon to form a sandwich of three layers.

By the method of the invention it is accomplished that the input material, prepared by screening and comminution, is divided into fractions such that the material will be in a sandwich of the material with a grain size distribution that assures optimum permeability and improved heat treatment of each layer of the material.

It is advantageous that the hopper or hoppers for the fines are arranged ahead of the hopper for the coarse material, so that the thin layer spread with the fines will come to lie as a first layer on the spreading and feeding belt, and the substantially thicker coarse material layer will lie on top of it. The depth of the layers is to be controlled according to the amount of the fines that will be best for the process. Due to the structure of the sandwich of material, the hot process water front E will flow uniformly first through depth $H_G$ of the coarse material layer, which will be about 65% to 90% of the total depth $\Sigma H$. The hot process water at about 200 to 220° C. is driven through by the steam pressure of about 16 bar to 24 bar acting on the hot water column E. Both of the media, hot water E and steam D, are fed downward into the material in the pressure chamber through the nozzles of the spreading system. As the hot water front E passes through, its perceptible heat is yielded to the cold material which is at about 20° C. room temperature. Along the steam front D the saturated steam condenses on the grain surfaces. The layers of material thus have a permeability that is optimum for each. Due to the sandwich structure of coarse and fine layers there can be no concentration of fines in the depth $H_G$ of the coarse material. The screened fine material is controlled at a relatively low depth $H_F$=10–35% of the total depth ΣH above the bottom dewatering filter surface of the MTE pressure chamber. Due to the controlled spreading of the fines a uniform permeability is present in the fines, which assures an even flow across their area of the media fronts D and E and prevents any uncontrolled separation in the coarse and fine regions due to the separate layers in the layer depths HG and $H_{F1}$+$H_{F2}$.

Due to the measured sifting out and processing of the fines content from the coarse material content of the starting material and the subsequent separate flow through the layers $H_G$, $H_F$, and $H_{F1}$+$H_{F2}$ there can be no intermixing of the coarse and fine granules while they are being spread on the spreading and feeding belt. Thus the dewatering efficiency in raw brown coal with a 55 to 65 weight-percent moisture content can be improved down to about 18% residual moisture content, including post-evaporation for dry brown coal. That is 25% more dewatering performance than practiced heretofore in the MTE process, which leads to a further increase of the heat value of the dry brown coal.

The higher dewatering power is due to the improved utilization of the perceptible heat in the recirculation of the MTE process water of 200 to 220° C., because the greater resistance offered by the fines layers to its passage produces a more intensive heat transfer to the surfaces of the grains. On account of this, the MTE process water is advantageously substantially cooler at about 30° C. at the filter belt surface upon exiting after its thermal energy is absorbed. The layers of the the fines furthermore have advantageously the action of a "carbon filter," so that the cold process water at about 30° C. is carried away as virtually clear water at the filter belt surface, that is, solid matter is filtered out more effectively and the cost of purifying the process water is thus markedly reduced. In comparison, in the formerly known MTE process, brown-colored water is carried out on the filter belt surface with an elevated solids content.

Additional advantageous measures and embodiments of the subject matter of the invention will be found in the subordinate claims and in the following description and drawing.

DETAILED DESCRIPTION OF THE PREFERRED EMBODIMENTS

Figure 1:
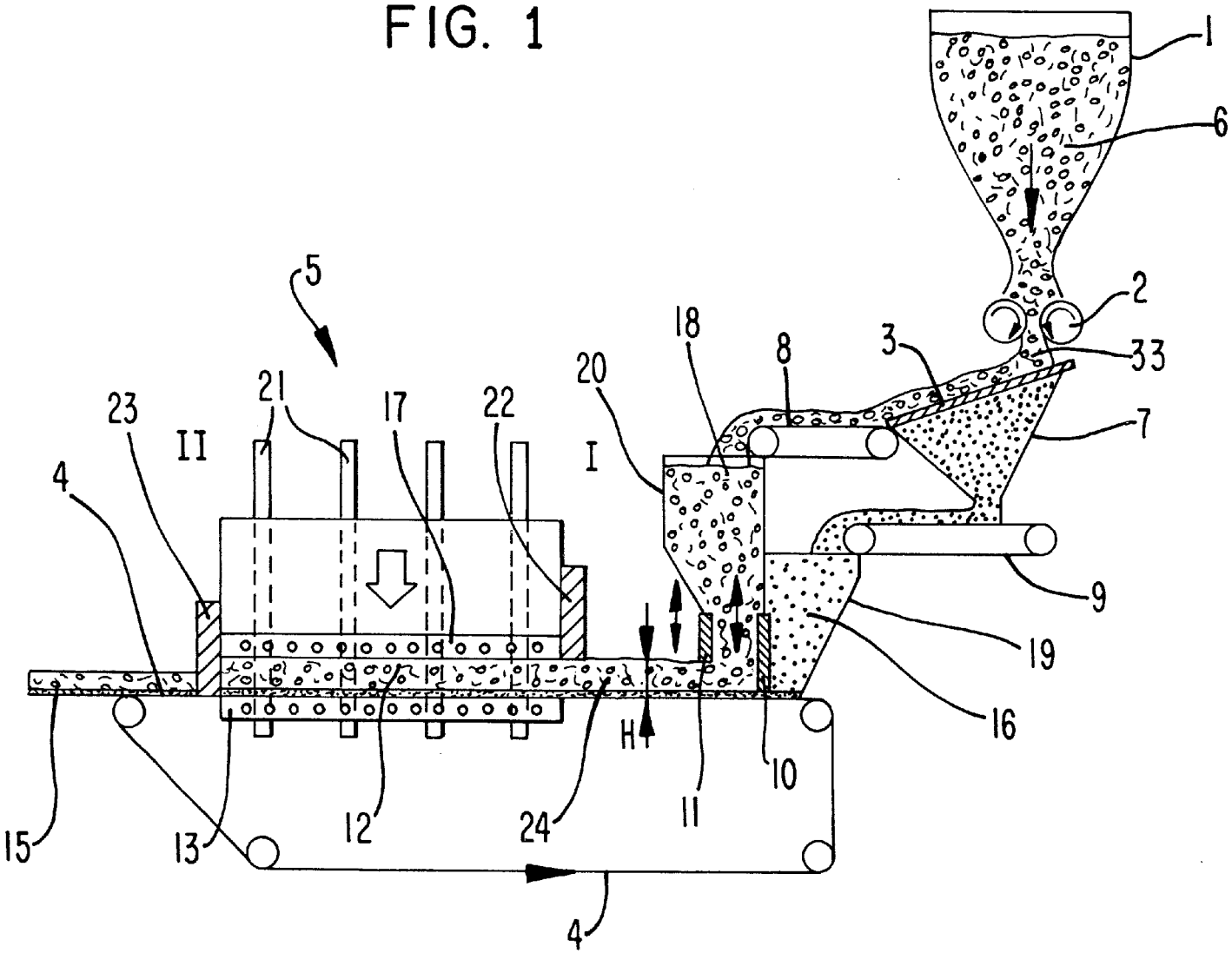
FIG. 1 is a side elevation of an apparatus for the practice of the method of the invention according to a first embodiment.
Figure 2:
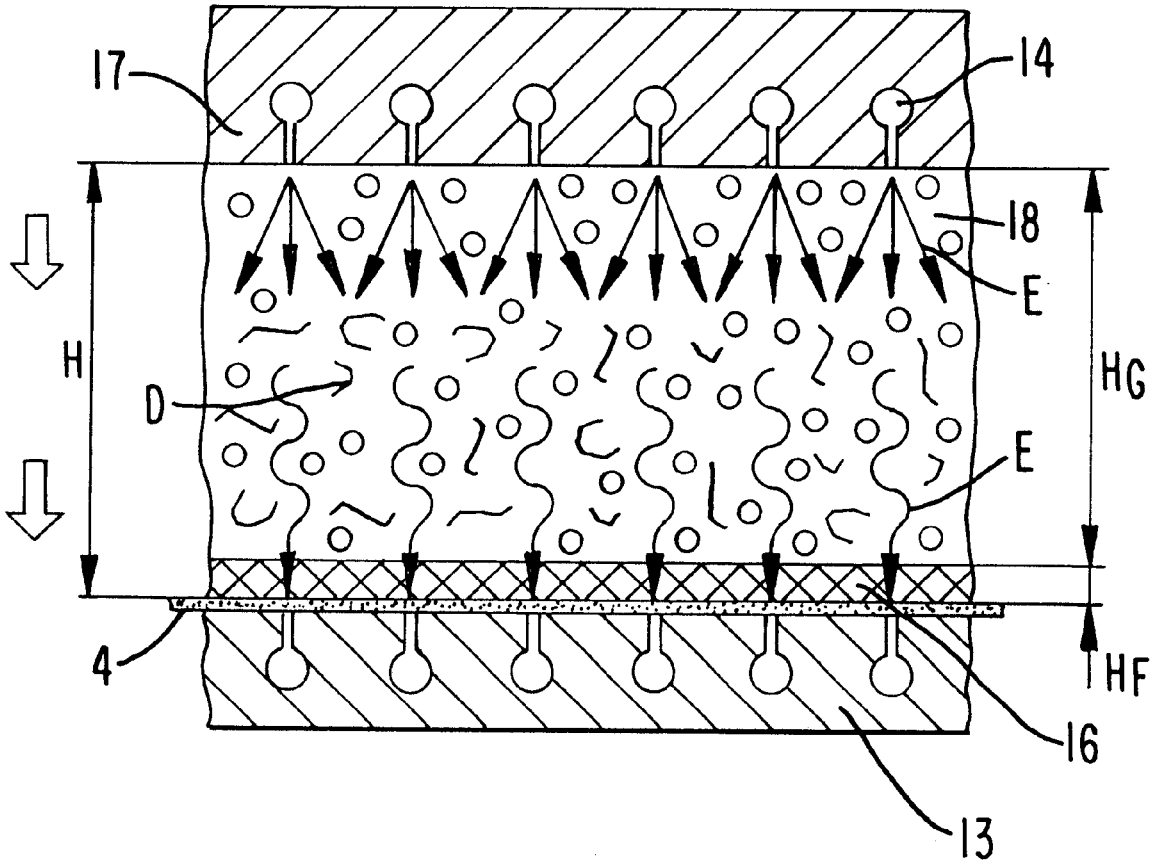
FIG. 2 shows how hot water E and saturated steam D are injected into and pass through the pressure chamber of the filter press.

FIGS. 1 and 2 show the apparatus of the invention with the initial hopper 1, the crusher 2, the screen belt system 3, the spreader hopper 20 for the coarse material 18, the spreader hopper 19 for the fines 16 and the filter press 5. The input material 6 is held in the initial hopper 1 and is drawn down by the crusher 2 and carried over the screen system 3 and the chute 7 as well as the conveyor belts 8 and 9 to the hopper 20 for the coarse material 18 and the hopper 19 for the fines 16. In the screening system 3 a measured separation of the fines 16 from the ground input material 6 is performed, so that the coarse material 18 contains only a measured residual content of fines 16 below the critical permeability limit. The screening system can be a controlled-frequency vibrating screen or ultrasound screen, wherein fines ranging from 0 to 3 mm are sifted out in measured amounts.

The coarse material 18 in an optimum MTE grain size range, and the fines 16, are taken by the spreading, feeding and filter belt 4 from the hopper 20 and from hopper 19. Hopper 19 is advantageously arranged ahead of hopper 20 and thus a thin spread layer of fines, $H_F$, is the first to be formed on the spreading, feeding and filter belt 4. Onto this outspread layer of fines $H_F$ the coarse material is spread to the depth $H_G$ with a limited fines content. The poured depths $H_F$ and $H_G$ are optimized for the process by adjustable sliding gates 10 and 11. After each dewatering cycle the MTE pressure chamber 12 is opened, so that the squeezed-out dry material 15 can be transported out and the sandwiched mat 24 can be brought in in synchronism by means of the controlled entry and discharge gates 22 and 23, respectively, and the spreading, feeding and filter belt 4. The filter press 5 with press frames 21 and with an integrated MTE pressure chamber and lock system is represented in FIGS. 1 and 2, while the MTE pressure chamber 12 with the steam and hot water distribution system 14 is shown in FIG. 2 in a section from FIG. 1. FIG. 2, furthermore, shows how the process water front E with the saturated steam D acts in the sandwich 24, the action proceeding from the upper press plate 17, and the squeezed-out water, mainly the cold process water, passes through the bottom press plate 13, in the thermal part of the process. The movable upper press plate 17 presses against the stationary press plate 13 in the mechanical part of the process. The spreading, feeding and filter belt 4 is, of course, permeable to water and consists of a woven metal wire belt. FIG. 2 further shows in detail the depth ratios of the coarse layer $H_G$ to the fine layer $H_F$ with the total depth H.

Figure 3:
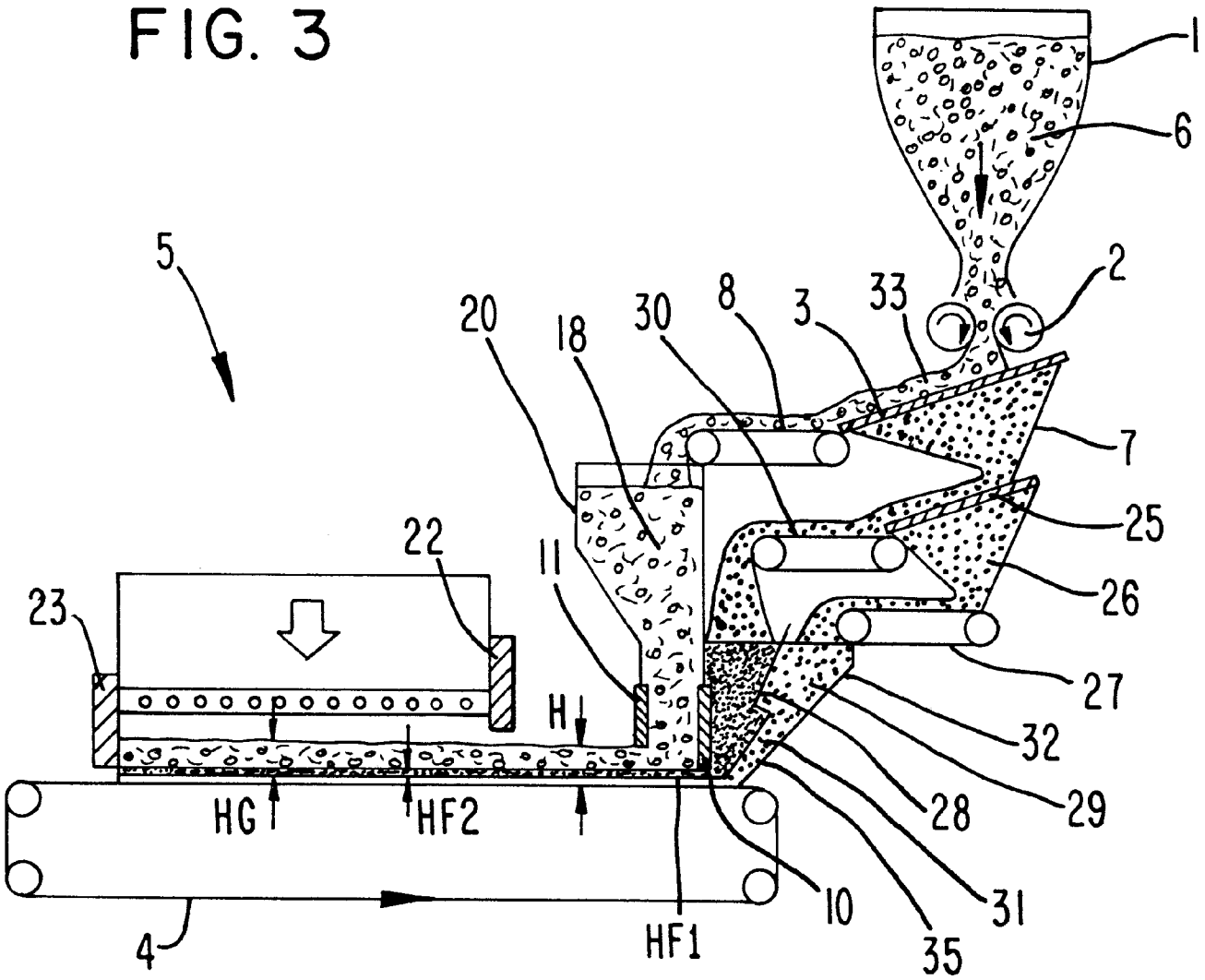
FIG. 3 shows the apparatus in a second embodiment for a spreading of the ground bulk material in three layers.

In FIG. 3 is shown a second embodiment of the apparatus of the invention. Accordingly, two screening systems 3 and 25 are provided for the material to be screened, one of them carrying the coarse material 18 of a fineness of 30 to 15 mm, for example, forward over the conveyor belt 8 into the hopper 20, and the separated fines from the screening system 25 are carried again in the screening system 25 to a fines hopper 28 with a fineness of 15 to 3 mm, for example, and to a superfines hopper 29 with a fineness of 3 to >0 mm, for example. The fines 28 are carried by the conveyor belt 30 into the hopper 31 and the superfines 29 are carried on the chute 26 and conveyor belt 27 into the hopper 32. When the material is spread and transported, this results in a sandwich of material 24 containing a first thin layer $H_{F1}$ of the superfines 29, its thickness regulated by the gate 35, on top of that a slightly thicker layer $H_{F2}$ of the fines 28, and on top of that a thick layer $H_G$ of coarse material 18.

Figure 4:
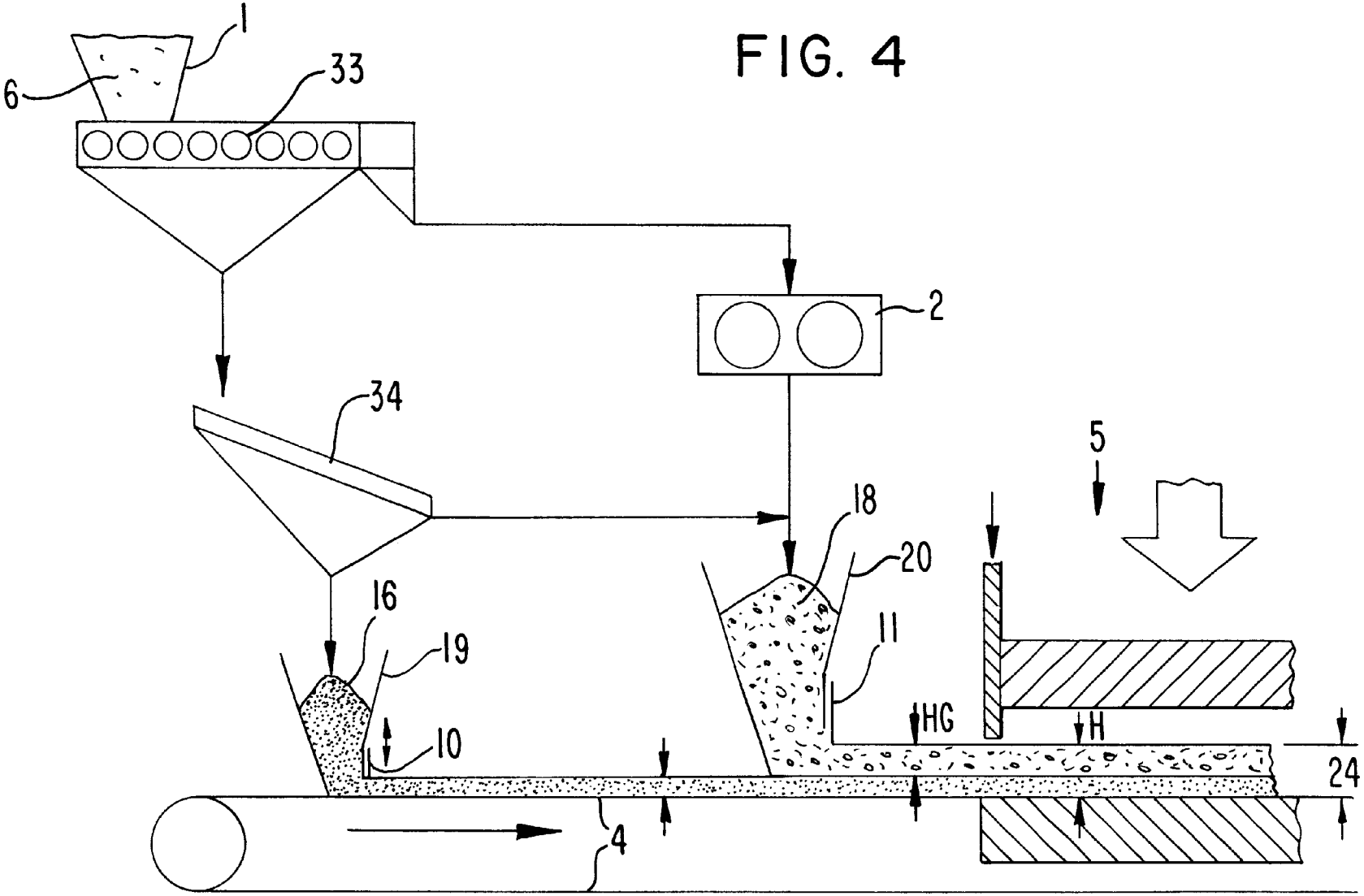
FIG. 4 shows a third embodiment for a two-layer spread.

FIG. 4 shows a third embodiment for treating the input material 6 by screening and comminution. The input material, with a grain size as delivered of up to 100 mm, is transported over a roller sifting system 33 and the material screened out with a grain size of, for example, <15 mm, is carried over another sifting system 34 wherein fines 16 with a grain size of, for example, <3 mm, are screened out and stored in hopper 19. The coarse input material 6 from the sifting system 33 with a grain size of 15 to 100 mm passes into the crusher 2 and there it is crushed to a <30 mm size with a residual fines content of <6% of a grain size under 1 mm, and is passed as coarse material 18 into the hopper 20. The separated coarse material 6 from the screening system 34 is also transported as coarse material 18 with a grain size of 3 to 15 mm, for example, into the hopper 20 for the layer $H_G$.

The rest of the process is the same as described in FIG. 1.

Figure 5:
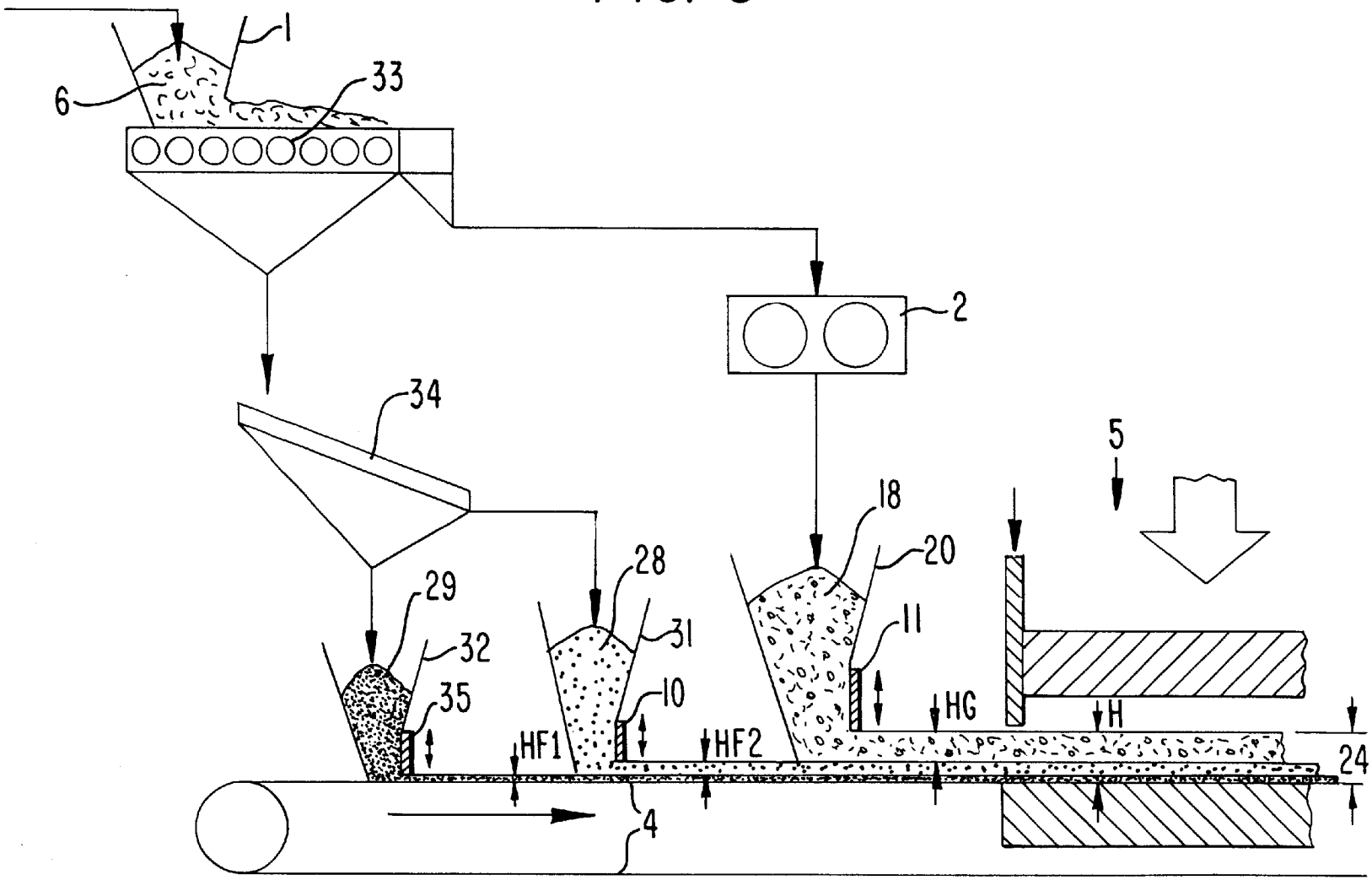
FIG. 5 shows a fourth embodiment for a three-layer spread.

FIG. 5 shows a fourth embodiment for the formation of a three-layer sandwich of the bulk material 24. The apparatus has mostly the same references as in FIGS. 3 and 4. The only difference in FIG. 4 is that the screened material with a grain size of, for example, 3 to 15 mm, from the screening system 33 and 34 is not transferred as coarse material 18 into the hopper 20, but passes as fine material 28 into hopper 31 and is spread from that as a second layer $H_{F2}$ onto layer $H_{F1}$. The rest of the process is the same as described for FIG. 3.

The priority document here, DE 199 40 392.9, filed Aug. 25, 1999, including its specification, drawings, and claims, is hereby incorporated by reference into this application.

What is claimed is:

1. A method for reducing the moisture content bound by capillarity in fiber cells of coal, comprising:

separating the coal into a plurality of portions, a first portion which comprises a coarse material having a residual amount of fine material, and a second portion which comprises fine material having a grain size smaller than a grain size of the coarse material;

depositing and spreading the fine material to form a first layer;

depositing and spreading the coarse material to form a second layer on top of the first layer, thereby forming a sandwich of spread material; and applying thermal energy and pressure to the sandwich.

2. The method of claim 1, wherein the coal comprises raw brown coal.

3. A method for reducing the moisture content bound by capillarity in fiber cells of solid input materials containing carbon, comprising:

separating the input material into a plurality of portions, a first portion which comprises a coarse material having a residual amount of fine material, and a second portion which comprises fine material having a grain size smaller than a grain size of the coarse material;

depositing and spreading the fine material to form a first layer;

depositing and spreading the coarse material to form a second layer on top of the first layer, thereby forming a sandwich of spread material; and applying thermal energy and mechanical energy to the sandwich; wherein the thermal energy application step comprises applying hot process water and saturated steam to the sandwich, and the mechanical energy application step comprises applying surface pressure to the sandwich.

4. The method of claim 3, wherein the thermal and mechanical energy application steps comprise using an MTE pressure chamber in a dewatering cycle to form a pressed-out dry material.

5. The method according to claim 4, wherein the dewatering of the sandwich of spread material is performed from above such that the second layer is the first one through which the hot process water and steam flow.

6. The method according to claim 4, characterized in that the flooding of the process water into the sandwich of spread material is performed with a temperature of about 200 to 220° C. and by a steam pressure acting on a column of process water of approximately 16 bar to 24 bar into the MTE pressure chamber.

7. The method of claim 4, wherein the second layer is thicker than the first layer.

8. The method of claim 7, further comprising grinding and screening the input material.

9. The method of claim 8, wherein the thicknesses of the first and second layers of the sandwich are determined according to the consistency and the amount of fine material of the input material used.

10. The method of claim 6, further comprising forming the first and second layers on a spreading, feeding and filter belt.

11. The method of claim 10, wherein the input material comprises raw brown coal.

12. The method of claim 11, further comprising the subsequent step of carrying away the pressed-out dry material while simultaneously applying thermal energy and pressure to an additional sandwich.

13. The method of claim 9, further comprising:

depositing the fine material into a first hopper; and depositing the coarse material into a second hopper.

14. The method according to claim 13, wherein the first layer comprises 10 to 35% of a total thickness of the sandwich.

15. A method for reducing the moisture content bound by capillarity in fiber cells of solid input materials containing carbon, comprising:

separating the input material into a plurality of portions by screening the input material through a plurality of screening systems arranged in tandem and depositing the portions into hoppers connected in tandem, the plurality of portions comprising a first portion which comprises a coarse material having a residual amount of fine material, and a second portion which comprises fine material having a grain size smaller than a grain size of the coarse material, wherein the fine material has a grain size of between 0 and 3 mm;

depositing and spreading the fine material to form a first layer;

depositing and spreading the coarse material to form a second layer on top of the first layer;

depositing and spreading at least one additional portion to form at least one additional layer; thereby forming a sandwich of spread material having at least a first, second, and at least one additional layer; and applying thermal energy and mechanical energy to the sandwich.

16. A method for reducing the moisture content bound by capillarity in fiber cells of solid input materials containing carbon, comprising:

separating the input material into a plurality of portions, the plurality of portions comprising a first portion which comprises a coarse material having a residual amount of fine material, and a second portion which comprises fine material having a grain size smaller than a grain size of the coarse material, wherein the fine material has a grain size of between 0 and 3 mm;

depositing and spreading the fine material to form a first layer;

depositing and spreading the coarse material to form a second layer on top of the first layer;

depositing and spreading at least one additional portion to form at least one additional layer; thereby forming a sandwich of spread material having at least a first, second, and at least one additional layer; and applying thermal energy and mechanical energy to the sandwich; wherein the sandwich is layered such that the layer of the sandwich of materials comprising coarse material is on top and layers comprising finer materials are spread below the top layer, the layers collectively having a gradation in grain size of >50 mm to >0 mm always smaller down to a bottom layer.

17. A method for reducing the moisture content bound by capillarity in fiber cells of solid input materials containing carbon, comprising:

separating the input material into a plurality of portions, a first portion which comprises a coarse material having a residual amount of fine material, and a second portion which comprises fine material having a grain size smaller than a grain size of the coarse material;

depositing and spreading the fine material to form a first layer;

depositing and spreading the coarse material to form a second layer on top of the first layer, thereby forming a sandwich of spread material; and applying thermal energy and pressure to the sandwich; wherein the residual amount has a grain size less than 1 mm and comprises less than 10% of the bulk content of the first portion.

18. A method for reducing the moisture content bound by capillarity in fiber cells of solid input materials containing carbon, comprising:

separating the input material into a plurality of portions by screening the input material through a plurality of screening systems arranged in tandem and depositing the portions into hoppers connected in tandem, the plurality of portions comprising:

a first portion which comprises a coarse material having a residual amount of finer material;

a second portion which comprises fine material having a residual amount of finer material and having a grain size smaller than a grain size of the coarse material; and a third portion which comprises a superfine material having a grain size of between 0 and 3 mm; wherein the fine material has a grain size larger than the grain size of the superfine material;

depositing and spreading the superfine material to form a first layer;

depositing and spreading the fine material to form a second layer;

depositing and spreading the coarse material to form a third layer above the first layer, thereby forming a sandwich of spread material; and applying thermal energy and mechanical energy to the sandwich.

19. A method for reducing the moisture content bound by capillarity in fiber cells of solid input materials containing carbon, comprising:

separating the input material into a plurality of portions, comprising:

a first portion which comprises a coarse material having a residual amount of finer material;

a second portion which comprises fine material having a residual amount of finer material and having a grain size smaller than a grain size of the coarse material; and a third portion which comprises a superfine material having a grain size of between 0 and 3 mm; wherein the fine material has a grain size larger than the grain size of the superfine material;

depositing and spreading the superfine material to form a first layer;

depositing and spreading the fine material to form a second layer;

depositing and spreading the coarse material to form a third layer above the first layer, thereby forming a sandwich of spread material; and applying thermal energy and mechanical energy to the sandwich; wherein at least one layer has a grain size of >50 mm.

20. A method for reducing the moisture content bound by capillarity in fiber cells of solid input materials containing carbon, comprising:

separating the input material into a plurality of portions by screening the input material through a plurality of screening systems arranged in tandem and depositing the portions into hoppers connected in tandem, the plurality of portions comprising a first portion which comprises a coarse material having a residual amount of fine material, and a second portion which comprises fine material having a grain size smaller than a grain size of the coarse material, depositing and spreading the fine material to form a first layer;

depositing and spreading the coarse material to form a second layer on above the first layer; and applying thermal energy and mechanical energy to the sandwich.

21. A method for reducing the moisture content bound by capillarity in fiber cells of solid input materials containing carbon, comprising:

separating the input material into a plurality of portions, the plurality of portions comprising a first portion which comprises a coarse material having a residual amount of fine material, and a second portion which comprises fine material having a grain size smaller than a grain size of the coarse material;

depositing and spreading the fine material to form a first layer;

depositing and spreading the coarse material to form a second layer on above the first layer;

applying thermal energy and mechanical energy to the sandwich; wherein at least one layer has a grain size of >50 mm.

* * * * *